US008687837B2

(12) United States Patent
Matsuo

(10) Patent No.: US 8,687,837 B2
(45) Date of Patent: Apr. 1, 2014

(54) ELECTROACOUSTIC TRANSDUCER

(75) Inventor: Yuji Matsuo, Daito (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 62 days.

(21) Appl. No.: 13/111,336

(22) Filed: May 19, 2011

(65) Prior Publication Data

US 2011/0293132 A1 Dec. 1, 2011

(30) Foreign Application Priority Data

May 28, 2010 (JP) ..... 2010-122723

(51) Int. Cl.
*H04R 1/00* (2006.01)
*H04R 9/06* (2006.01)
*H04R 11/02* (2006.01)

(52) U.S. Cl.
USPC ..... 381/398; 381/409; 381/417; 381/418; 381/420

(58) Field of Classification Search
USPC ..... 381/398, 409, 417–418, 420
See application file for complete search history.

(56) References Cited

U.S. PATENT DOCUMENTS

| | | | | |
|---|---|---|---|---|
| 4,520,237 | A * | 5/1985 | Murakami | 381/412 |
| 6,674,872 | B2 * | 1/2004 | Fujinami et al. | 381/409 |
| 6,782,114 | B2 * | 8/2004 | Ando et al. | 381/398 |
| 2009/0296979 | A1 * | 12/2009 | Kamimura et al. | 381/412 |

FOREIGN PATENT DOCUMENTS

| | | | |
|---|---|---|---|
| JP | 2003348679 | A | 12/2003 |
| JP | 2004-129080 | A | 4/2004 |

OTHER PUBLICATIONS

Office Action mailing date Jan. 14, 2014 issued in corresponding Japanese Patent Application No. 2010-122723 (3 pages), with partial English translation.

* cited by examiner

*Primary Examiner* — Duc Nguyen
*Assistant Examiner* — Sean H Nguyen
(74) *Attorney, Agent, or Firm* — Westerman, Hattori, Daniels & Adrian, LLP

(57) ABSTRACT

A frame has a notch having an opening at a side plane of the frame. A diaphragm is vibratably attached to one plane of the frame. A voice coil is attached to the diaphragm. A terminal is attached to the other plane of the frame. A lead is connected to the voice coil, drawn from one plane to the other plane through the notch, and connected to the terminal. One of intersection points at which a normal to the side plane that passes through the position of the lead in the notch and the side plane intersect that is closest to the opening and the lead in the notch are intervened therebetween by the frame.

5 Claims, 8 Drawing Sheets

ELECTROACOUSTIC TRANSDUCER

This nonprovisional application is based on Japanese Patent Application No. 2010-122723 filed on May 28, 2010 with the Japan Patent Office, the entire contents of which are hereby incorporated by reference.

BACKGROUND OF THE INVENTION

1. Field of the Invention

The present invention relates generally to electroacoustic transducers and particularly to electroacoustic transducers having a lead connected to a voice coil.

2. Description of the Related Art

Mobile phones and other similar electronics have an electroacoustic transducer mounted therein. The electroacoustic transducer is a device transducing an electrical signal to an acoustic signal and vice versa, such as a speaker or a microphone. For example, as disclosed in Japanese Patent Laying-open No. 2004-129080, a typical electroacoustic transducer has a lead connected to a voice coil, and the lead is drawn via a recess of a side plane of a frame out to a back plane of the electroacoustic transducer.

When an electroacoustic transducer is fabricated, inspected, shipped and mounted, its frame has a side plane receiving a variety of types of external force. This external force is caused as an operator or a robot holds the electroacoustic device or as the electroacoustic device collides against another component, a casing, or a similar, neighboring structure when the electroacoustic device is mounted. The external force is mainly directed along a normal to the side plane of the frame toward the frame's inner portion. If this force toward the frame's inner portion acts exactly on the position of the lead, the lead may be damaged.

SUMMARY OF THE INVENTION

The present invention has been made in view of the above issue and it contemplates an electroacoustic transducer that can prevent a lead from damage while a side plane of a frame receives external force.

The present electroacoustic transducer has a frame, a diaphragm, a voice coil, a terminal, and a lead. The frame has a first plane and a second plane opposite to the first plane and a side plane connecting one and the other planes, and a notch having an opening at the side plane to connect the first and the second planes. The diaphragm is vibratably attached to the frame at the first plane. The voice coil is attached to the diaphragm. The terminal is attached to the frame at the second plane. The lead is connected to the voice coil, drawn from the first plane to the second plane through the notch, and connected to the terminal. When the frame is seen in a direction in which the first and the second planes are opposite to each other, the frame intervenes between the lead in the notch and one of intersection points at which a normal to the side plane that passes through the position of the lead in the notch and the side plane intersect, the one of the intersection points being closest to the opening.

In accordance with the present invention, one of intersection points at which a normal to the side plane that passes through the position of the lead in the notch and the side plane intersect that is closest to the opening and the lead in the notch are intervened therebetween by the frame. Thus, force exerted through the intersection point that is closest to the opening in the direction of the normal toward the lead, i.e., main force exerted from the frame's side plane toward the lead, is interrupted by the frame. The lead can thus be prevented from damage otherwise caused by external force exerted to the frame's side plane.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter reference will be made to the drawings to describe the present invention in embodiment.

Figure 1:
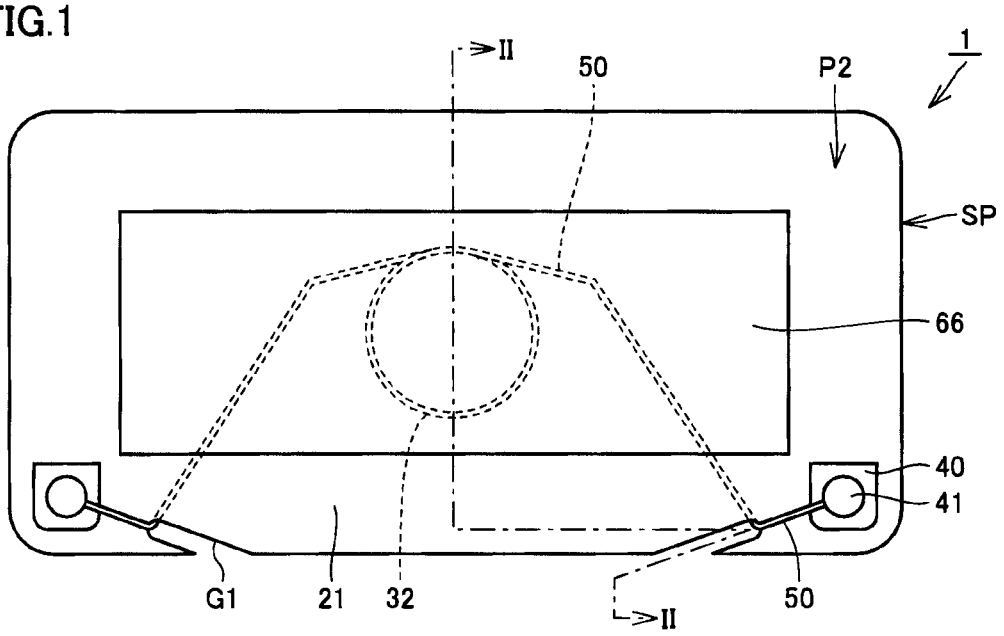
FIG. 1 shows the present electroacoustic transducer in one embodiment in the form of a speaker in configuration schematically in a bottom view.
Figure 2:
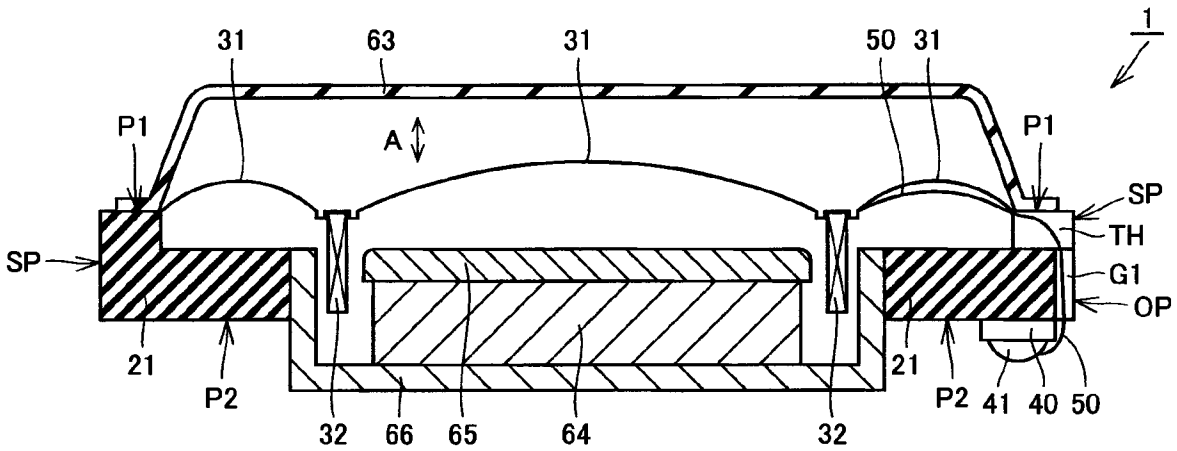
FIG. 2 is a schematic cross section taken along a line II-II of FIG. 1.
Figure 3:
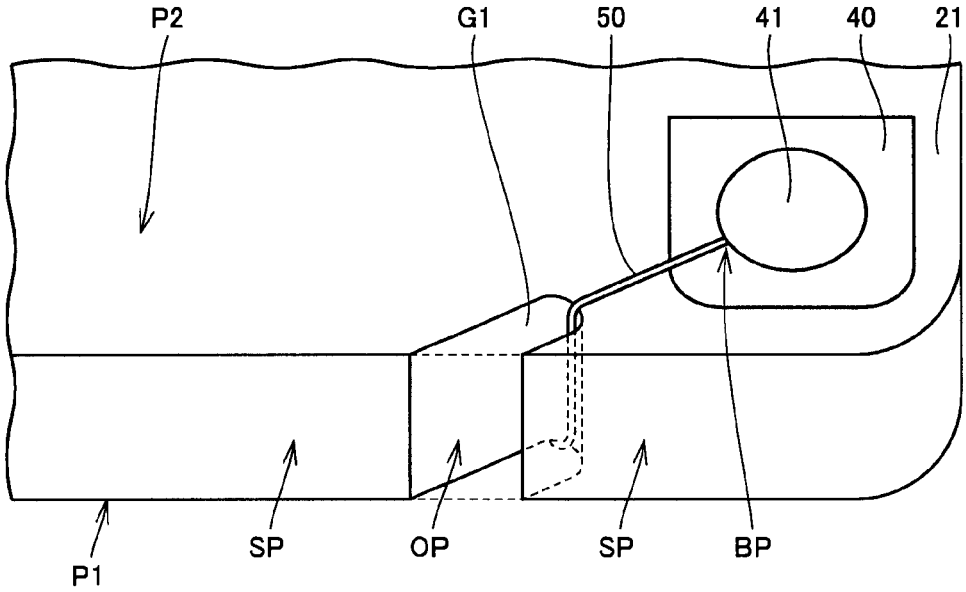
FIG. 3 shows a vicinity of the FIG. 1 speaker's notch and terminal in configuration schematically in a perspective view.

With reference to FIGS. 1-3, the present embodiment provides an electroacoustic transducer in the form of a speaker 1 having a frame 21, a diaphragm 31, a voice coil 32, a terminal 40, a lead 50, a frame cover 63, a magnet 64, a plate 65, and a yoke 66.

Frame 21 has a diaphragm attachment plane P1 (or the first plane) and a terminal attachment plane P2 (or the second plane) opposite to each other, and a side plane SP connecting diaphragm attachment plane P1 and terminal attachment plane P2. Furthermore, frame 21 is provided at side plane SP with a notch G1 provided at side plane SP with an opening OP to connect diaphragm attachment plane P1 and terminal attachment plane P2. Frame 21 at diaphragm attachment plane P1 has an edge of diaphragm 31 attached thereto. Diaphragm 31 thus has a center supported to be vibratable in a direction in which diaphragm attachment plane P1 and terminal attachment plane P2 are opposite to each other (i.e., a direction A indicated in FIG. 2). Diaphragm 31 at the center has voice coil 32 attached thereto for driving diaphragm 31 in response to an electrical signal. Frame 21 at terminal attachment plane P2 has terminal 40 attached thereto for externally inputting an electrical signal to speaker 1.

Lead 50 has one end connected to voice coil 32. Lead 50 is drawn out from voice coil 32 externally through a gap TH formed between diaphragm 31 and frame 21 (see FIG. 1). Lead 50 externally drawn out is drawn from diaphragm attachment plane P1 to terminal attachment plane P2 through notch G1 provided at side plane SP. The lead drawn out to terminal attachment plane P2 is connected to terminal 40. This connection is done for example by soldering forming a solder portion 41.

Furthermore, lead 50 is exposed, rather than covered, in notch G1. In other words, a step of covering lead 50 in notch G1 is not performed. A reduced production cost can thus be achieved.

Figure 4:
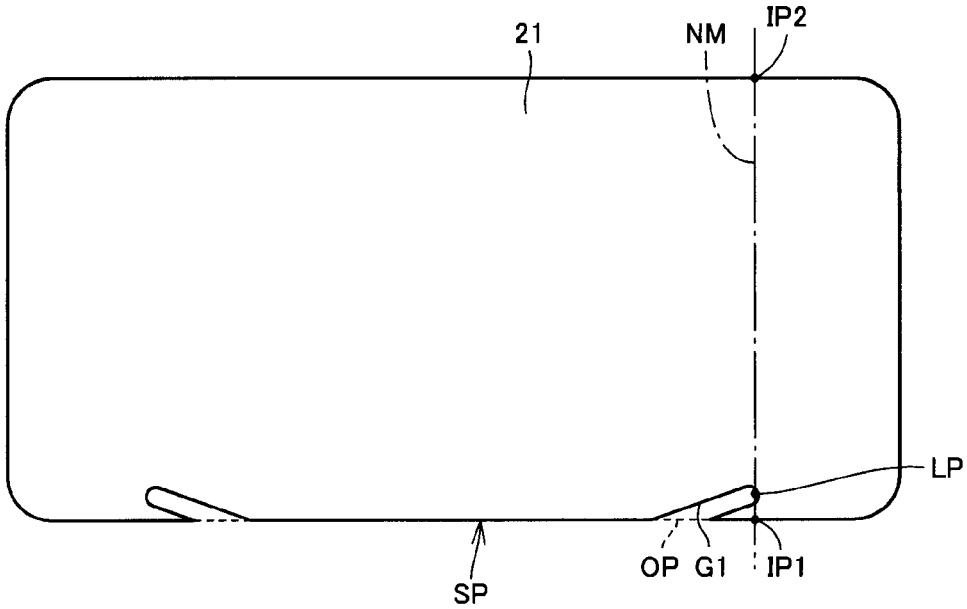
FIG. 4 schematically shows an external edge of a frame of the FIG. 1 speaker.
Figure 5:
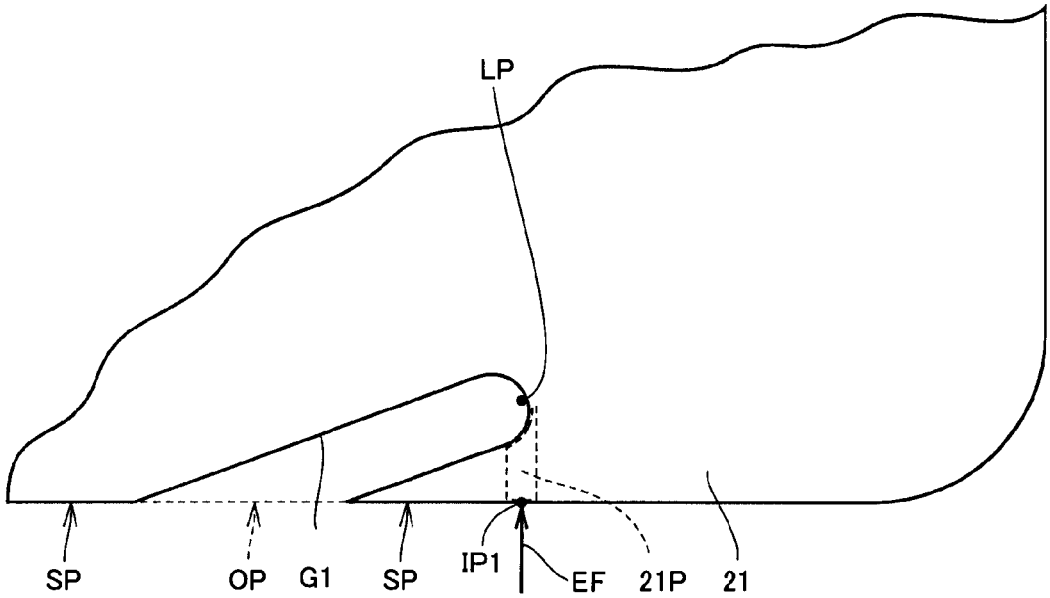
FIG. 5 is an enlarged view of a vicinity of the notch shown in FIG. 4.

With reference to FIGS. 4 and 5, when seen in the direction in which diaphragm attachment plane P1 and terminal attachment plane P2 are opposite to each other, the frame 21 side plane SP is generally rectangular and has its corners rounded. A position LP is the position of lead 50 in notch G1. A normal NM is a normal to side plane SP that passes through position LP. Intersection points IP1 and IP2 are points at which normal NM and side plane SP intersect. Of these intersection points, an intersection point closest to opening OP, i.e., intersection point IP1, and position LP, i.e., lead 50 in notch G1, are intervened therebetween by a portion 21P of frame 21.

Figure 6:
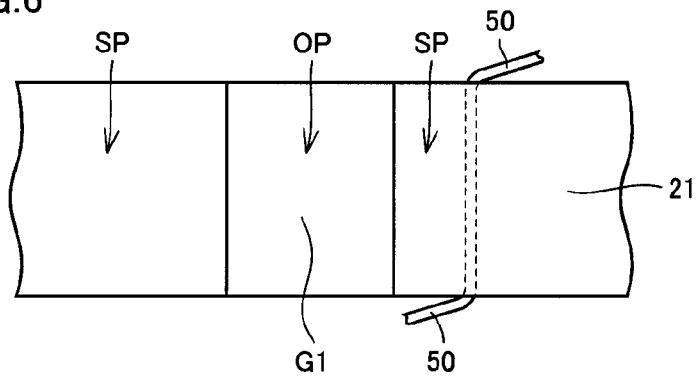
FIG. 6 shows a vicinity of an opening of the notch of the FIG. 1 speaker in configuration schematically in a partial side view.

With reference to FIG. 6, when opening OP is seen along normal NM to side plane SP (see FIG. 4), lead 50 is not exposed from opening OP. This is because lead 50 is covered with the frame 21 portion 21P (see FIG. 5)

Figure 7:
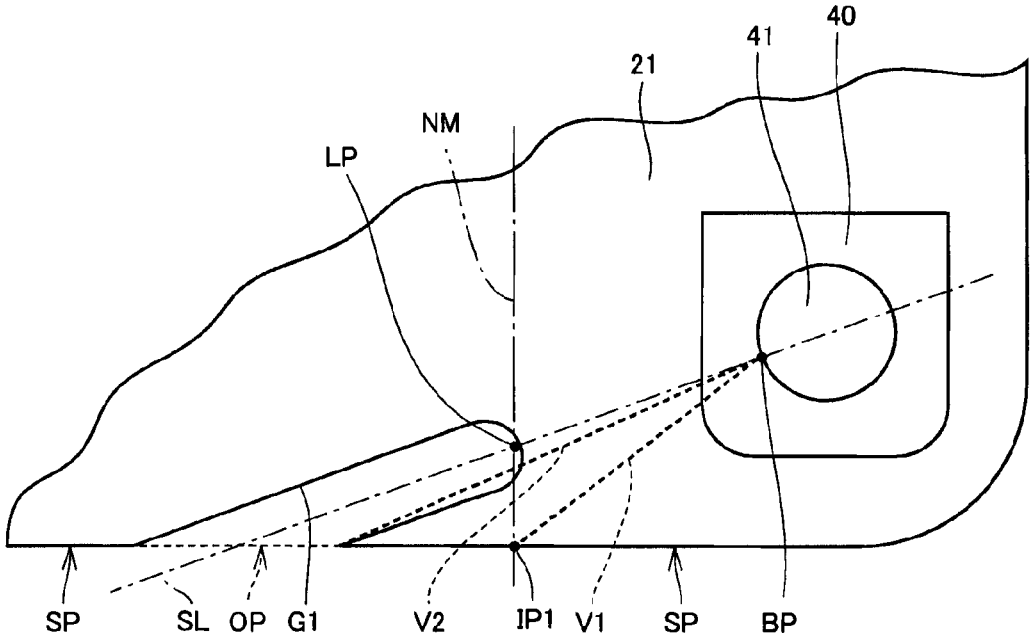
FIG. 7 shows a vicinity of the FIG. 1 speaker's notch and terminal in configuration schematically in a partial bottom view.

With reference to FIG. 7, when seen in the direction in which diaphragm attachment plane P1 and terminal attachment plane P2 (see FIG. 3) are opposite to each other, notch G1 extends along a virtual straight line SL (or one straight line). Straight line SL inclines relative to normal NM to side plane SP at intersection point IP1 closest to opening OP. Notch G1 extending along straight line SL allows lead 50 to be wired in such a manner that lead 50 is introduced into notch G1 along straight line SL. This facilitates wiring lead 50.

Furthermore, terminal 40 is disposed to have a smaller distance to intersection point IP1 (indicated by the length of a broken line V1) than that to opening OP (indicated by the length of a broken line V2). Notch G1 can thus have opening OP distant from terminal 40, and accordingly, lead 50 does not easily come off notch G1. Note that a distance from terminal 40 is specifically a distance from an end BP at which lead 50 is restrained on terminal 40, and this restraint is done for example by solder portion 41.

Furthermore, terminal 40 is disposed on straight line SL. This allows lead 50 wired along straight line SL to be connected to terminal 40 without positional adjustment.

Figure 8:
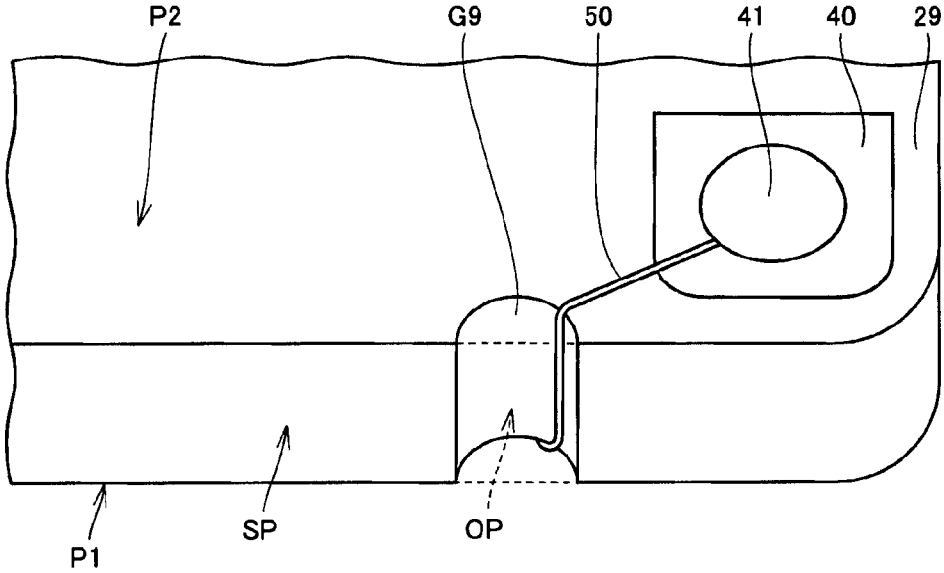
FIG. 8 shows a vicinity of a notch and terminal of a speaker of a comparative example in configuration schematically in a perspective view.
Figure 9:
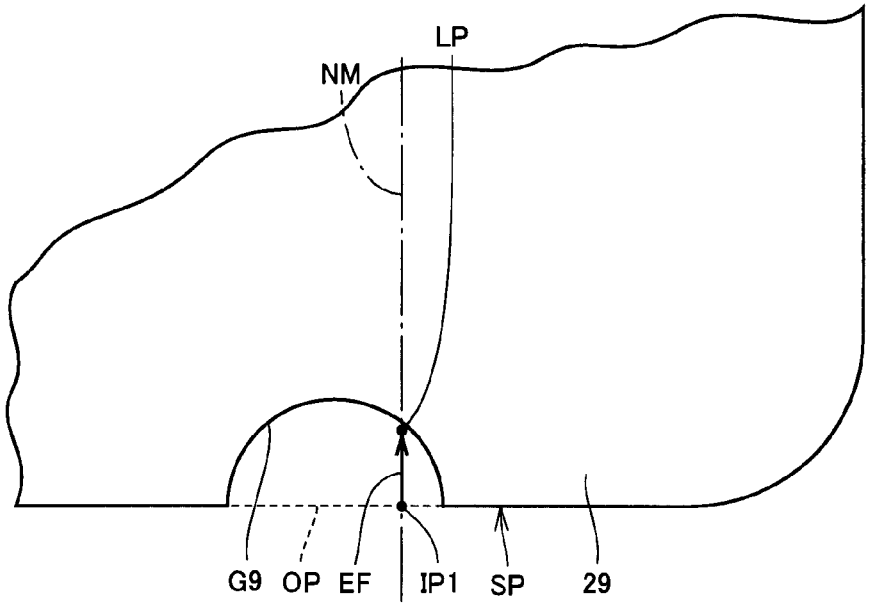
FIG. 9 shows an external edge of a frame of the FIG. 8 speaker in a vicinity of the notch.
Figure 10:
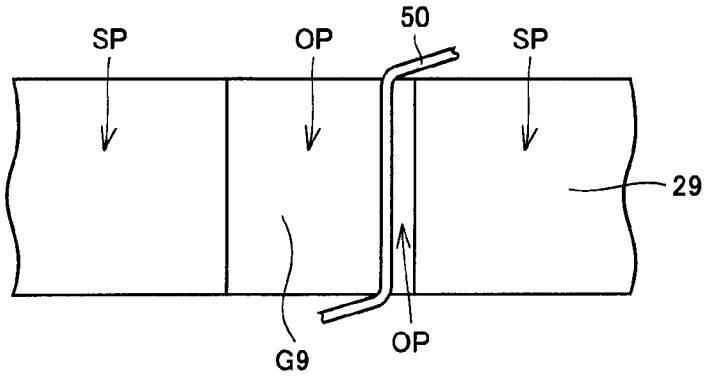
FIG. 10 shows a vicinity of an opening of the notch of the FIG. 8 speaker in configuration schematically in a partial side view.

A speaker of a comparative example will be described hereinafter. FIGS. 8-10 show the comparative example in configuration, as seen at the points of views in the present embodiment corresponding to FIGS. 3, 5 and 6, respectively. The comparative example provides a semi circular notch G9, as shown in FIG. 9. Accordingly, intersection point IP1 and position LP or lead 50 in notch G9 are not intervened therebetween by a frame 29. Thus, as shown in FIG. 10, when opening OP is seen along the normal to side plane SP, lead 50 is exposed through opening OP.

In the above comparative example, intersection point IP1 and lead 50 in notch G9 are not intervened therebetween by frame 29. Thus, force EF (external force) exerted through intersection point IP1 in the direction of normal NM toward lead 50, i.e., main force exerted from the frame 29 side plane SP toward lead 50, is not interrupted by frame 29. Lead 50 is thus damageable by force EF exerted to the frame 29 side plane SP.

This damage can be prevented by additionally introducing a step of covering lead 50 in notch G9. Such an additional step, however, would result in an increased production cost. Furthermore, if lead 50 is covered by a bonding material applied thereto, the bonding material may drip out of notch G9, and as a result the product may have a geometrical, dimensional error.

In contrast, the present embodiment allows intersection point IP1 and lead 50 in notch G1 to be intervened therebetween by the frame 21 portion 21P (see FIG. 5). Thus, force EF exerted through intersection point IP1 in the direction of normal NM toward lead 50, i.e., main force exerted from the frame 29 side plane SP toward lead 50, is interrupted by the frame 21 portion 21P. Lead 50 can thus be prevented from damage otherwise caused by force EF exerted to the frame 29 side plane SP.

Note that preferably, notch G1 is provided in such a manner that straight line SL (see FIG. 7) inclines relative to a normal to opening OP (not shown). This can prevent external force from readily entering notch G1 through opening OP and thus further prevent the external force from damaging lead 50.

The present embodiment in four exemplary variations will be described hereinafter.

Figure 11:
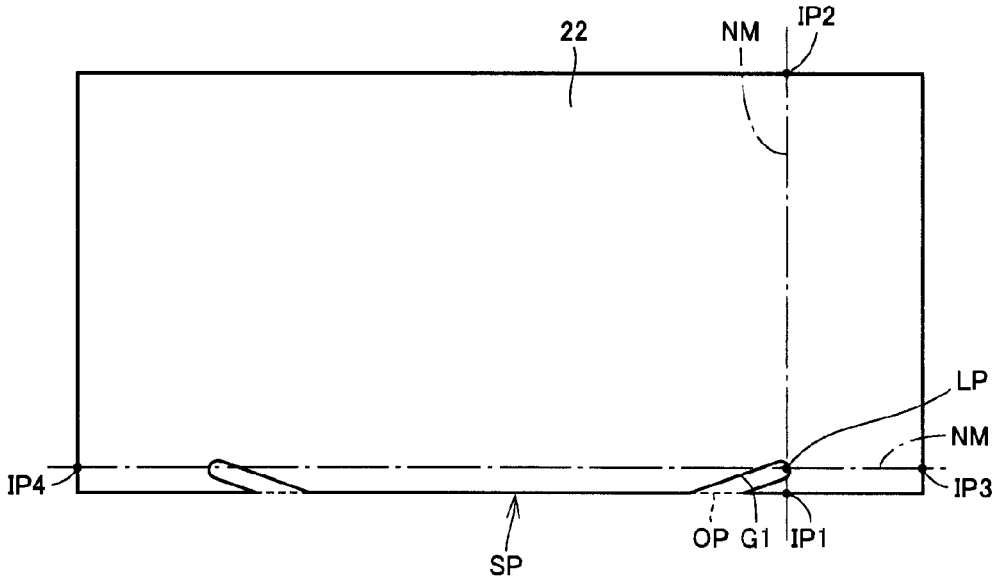
FIGS. 11-14 schematically show first to fourth exemplary variations of the external edge of the frame of the speaker.

FIG. 11 shows side plane SP of a frame 22 of the first exemplary variation in geometry, as seen at a point of view in the present embodiment corresponding to FIG. 4. In contrast to frame 21 (see FIG. 4), frame 22 has side plane SP that substantially does not have its corner rounded. Accordingly, normal NM to side plane SP that passes through position LP and side plane SP intersect at points IP1 and IP2 (see FIG. 4) and, in addition, points IP3 and IP4. Of intersection points IP1 to IP4, intersection point IP1 is the closest to opening OP.

Figure 12:
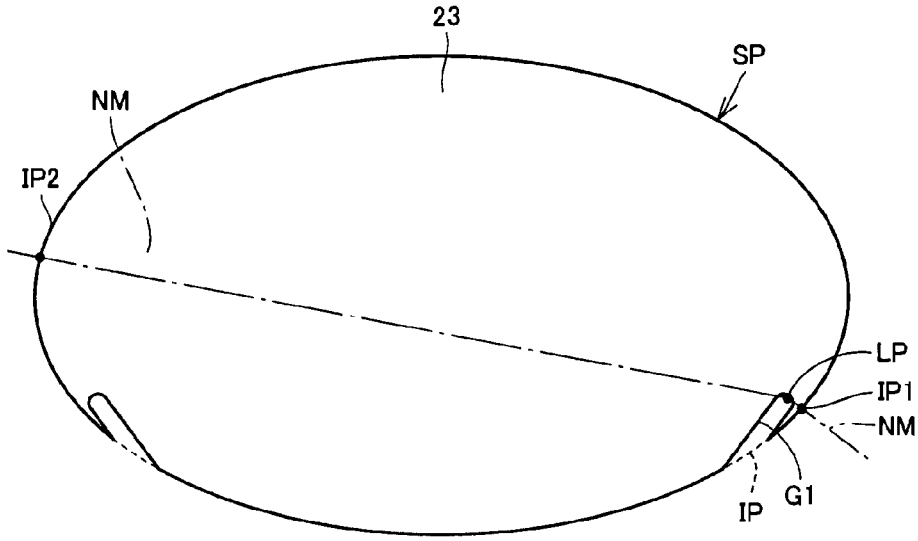

FIG. 12 shows side plane SP of a frame 23 of the second exemplary variation in geometry, as seen at the point of view in the present embodiment corresponding to FIG. 4. Frame 23 has side plane SP in the form of an ellipse.

Figure 13:
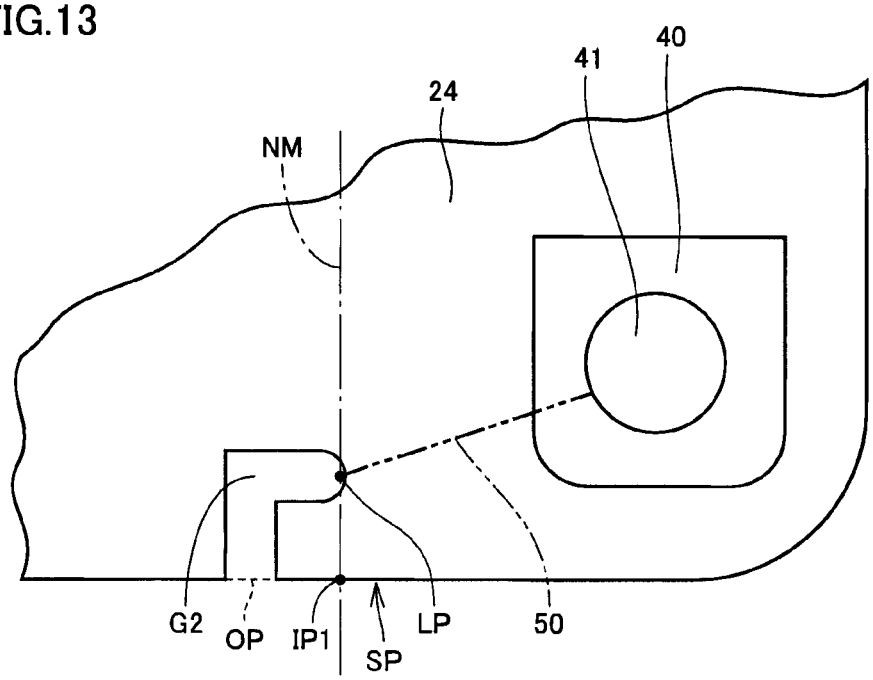

FIG. 13 shows a portion in geometry of a frame 24 in the third exemplary variation, as seen at a point of view in the present embodiment corresponding to FIG. 7. Frame 24 has side plane SP with a notch G2, which does not have a portion extending with an inclination relative to normal NM. Rather, notch G2 is doglegged.

Figure 14:
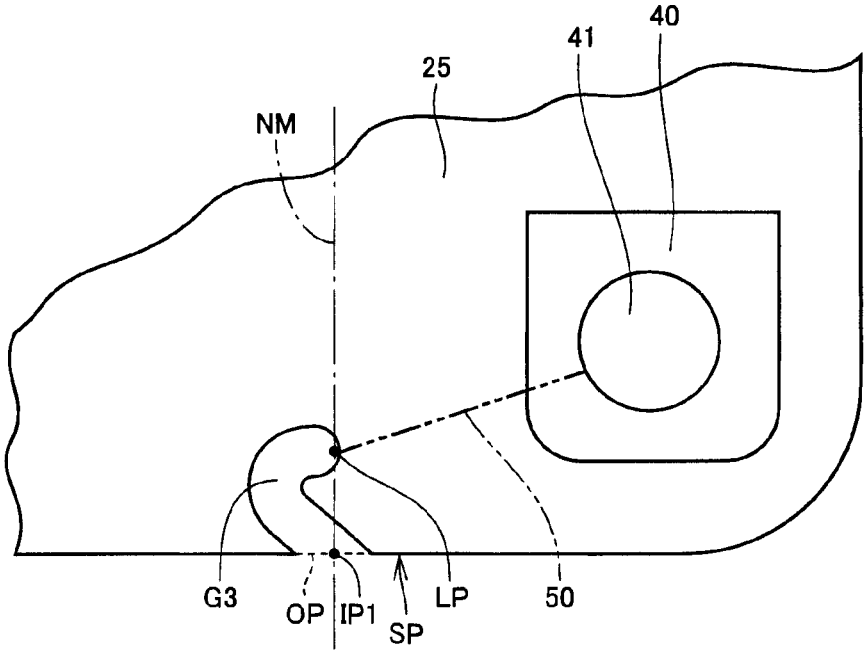

FIG. 14 shows a portion in geometry of a frame 25 in the fourth exemplary variation, as seen at the point of view corresponding to FIG. 7. Frame 25 has side plane SP with a notch G3, which has intersection point IP1 on opening OP. Frame 25 intervenes between intersection point IP1 and position LP at a position distant from intersection point IP1.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An electroacoustic transducer comprising:

a frame which has a first plane and a second plane opposite to said first plane and a side plane connecting said first and second planes, and a notch having an opening at said side plane to connect said first and second planes;

a diaphragm which is vibratably attached to said frame at said first plane;

a voice coil which is attached to said diaphragm;

a terminal which is attached to said frame at said second plane; and a lead which is connected to said voice coil, drawn from said first plane to said second plane through said notch, and connected to said terminal, wherein when said frame is seen in a direction in which said first and second planes are opposite to each other, said frame intervenes between said lead in said notch and one of intersection points at which a normal to said side plane that passes through a position of said lead in said notch and said side plane intersect, said one of said intersection points being closest to said opening one of said intersection points being closest to said opening, wherein said side plane covers planes of said frame not covered by said first and second planes, and another one of said intersection points is located on said normal to said side plane in an opposite side of said side plane, said another one of said intersection points not being said one of said intersection points.

2. The electroacoustic transducer according to claim 1, wherein when seen in said direction in which said first and second planes are opposite to each other, said notch extends along one virtual straight line inclined relative to said normal to said side plane associated at said one of said intersection points closest to said opening.

3. The electroacoustic transducer according to claim 2, wherein when seen in said direction in which said first and second planes are opposite to each other, said terminal is disposed to have a smaller distance to said one of said intersection points closest to said opening than that to said opening.

4. The electroacoustic transducer according to claim 2, wherein when seen in said direction in which said first and second planes are opposite to each other, said terminal is disposed on said one straight line.

5. The electroacoustic transducer according to claim 1, wherein said lead has a portion exposed, rather than covered, in said notch.

* * * * *